US010888474B2

(12) United States Patent
Kim et al.

(10) Patent No.: US 10,888,474 B2
(45) Date of Patent: Jan. 12, 2021

(54) WHEELCHAIR POWER APPARATUS FOR ELECTRONIC DRIVING CONVERSION

(71) Applicants: Joon-Hyung Kim, Seoul (KR); Seong Hyun Paek, Gwangju-si (KR)

(72) Inventors: Joon-Hyung Kim, Seoul (KR); Seong Hyun Paek, Gwangju-si (KR)

(73) Assignee: ROBO3 CO., LTD., Seoul (KR)

( * ) Notice: Subject to any disclaimer, the term of this patent is extended or adjusted under 35 U.S.C. 154(b) by 205 days.

(21) Appl. No.: 16/202,765

(22) Filed: Nov. 28, 2018

(65) Prior Publication Data

US 2019/0183698 A1 Jun. 20, 2019

(30) Foreign Application Priority Data

Dec. 20, 2017 (KR) ..... 10-2017-0176355

(51) Int. Cl.

| | |
|---|---|
| ***A61G 5/04*** | (2013.01) |
| *A61G 5/02* | (2006.01) |
| *A61G 5/10* | (2006.01) |

(52) U.S. Cl.

CPC ..... *A61G 5/047* (2013.01); *A61G 5/046* (2013.01); *A61G 5/02* (2013.01); *A61G 5/048* (2016.11); *A61G 5/10* (2013.01)

(58) Field of Classification Search

CPC ..... A61G 5/047; A61G 5/042; A61G 5/048; A61G 5/02

See application file for complete search history.

(56) References Cited

U.S. PATENT DOCUMENTS

| | | | | |
|---|---|---|---|---|
| 4,386,672 | A * | 6/1983 | Coker | A61G 5/047 180/13 |
| 4,503,925 | A * | 3/1985 | Palmer | A61G 5/047 180/13 |
| 5,016,720 | A * | 5/1991 | Coker | A61G 5/047 180/13 |
| 5,050,695 | A * | 9/1991 | Kleinwolterink, Jr. | A61G 5/047 180/13 |
| 5,494,126 | A * | 2/1996 | Meeker | A61G 5/047 180/13 |
| 5,651,422 | A * | 7/1997 | Casali | A61G 5/047 180/13 |
| 5,826,670 | A * | 10/1998 | Nan | A61G 5/047 180/15 |
| 6,883,632 | B2 * | 4/2005 | McHardy | A61G 5/047 180/13 |
| 7,174,093 | B2 * | 2/2007 | Kidd | A61G 5/047 180/58 |
| 7,216,728 | B2 * | 5/2007 | Huang | A61G 5/047 180/13 |

(Continued)

*Primary Examiner* — Kevin Hurley
*Assistant Examiner* — Michael R Stabley
(74) *Attorney, Agent, or Firm* — John K. Park; Park Law Firm

(57) ABSTRACT

Disclosed is a wheelchair power apparatus for electronic driving conversion. It is an object of the present invention to provide a wheelchair power apparatus for electronic driving conversion, which can provide severely disabled people, for instance, patients with spinal cord injury, the weak or the old, who use wheelchairs, with convenience in movement, and convert a manual four-wheel wheelchair into an electronic three-wheel wheelchair just by detachably mounting the electronic module having electronic wheels to the existing manual four-wheel wheelchair.

6 Claims, 10 Drawing Sheets

(56) References Cited

U.S. PATENT DOCUMENTS

| | | | | |
|---|---|---|---|---|
| 7,306,250 | B1 * | 12/2007 | Mills | A61G 5/047 180/11 |
| 7,694,991 | B2 * | 4/2010 | Mills | A61G 5/1051 180/11 |
| 7,976,049 | B2 * | 7/2011 | Chiu | A61G 5/047 180/13 |
| 8,684,113 | B1 * | 4/2014 | Laconis | A61G 5/047 180/11 |
| 9,326,901 | B2 * | 5/2016 | Conte | A61G 5/047 |
| 9,872,805 | B2 * | 1/2018 | Bach Castillo | B62K 5/025 |
| 10,076,457 | B2 * | 9/2018 | Behm | A61G 5/025 |
| 10,299,973 | B2 * | 5/2019 | Conte | A61G 5/04 |
| 2004/0108147 | A1 * | 6/2004 | Ross | A61G 5/047 180/13 |
| 2005/0206115 | A1 * | 9/2005 | Lee | A61G 5/047 280/250.1 |
| 2006/0000664 | A1 * | 1/2006 | Huang | A61G 5/047 180/198 |
| 2007/0096427 | A1 * | 5/2007 | Knaub | A61G 5/1051 280/304.1 |
| 2008/0115982 | A1 * | 5/2008 | Lin | A61G 5/1051 180/13 |
| 2011/0095508 | A1 * | 4/2011 | Chiu | A61G 5/047 280/304.1 |
| 2015/0351979 | A1 * | 12/2015 | Conte | B62B 3/0612 180/13 |
| 2016/0317368 | A1 * | 11/2016 | Bach Castillo | A61G 5/027 |
| 2018/0028378 | A1 * | 2/2018 | Behm | A61G 5/042 |
| 2018/0140486 | A1 * | 5/2018 | Klein | A61G 5/122 |
| 2018/0147100 | A1 * | 5/2018 | Conte | A61G 5/10 |
| 2018/0338877 | A1 * | 11/2018 | Kano | A61G 5/047 |
| 2019/0015272 | A1 * | 1/2019 | Benedini | A61G 5/047 |

* cited by examiner

【Figure 1】
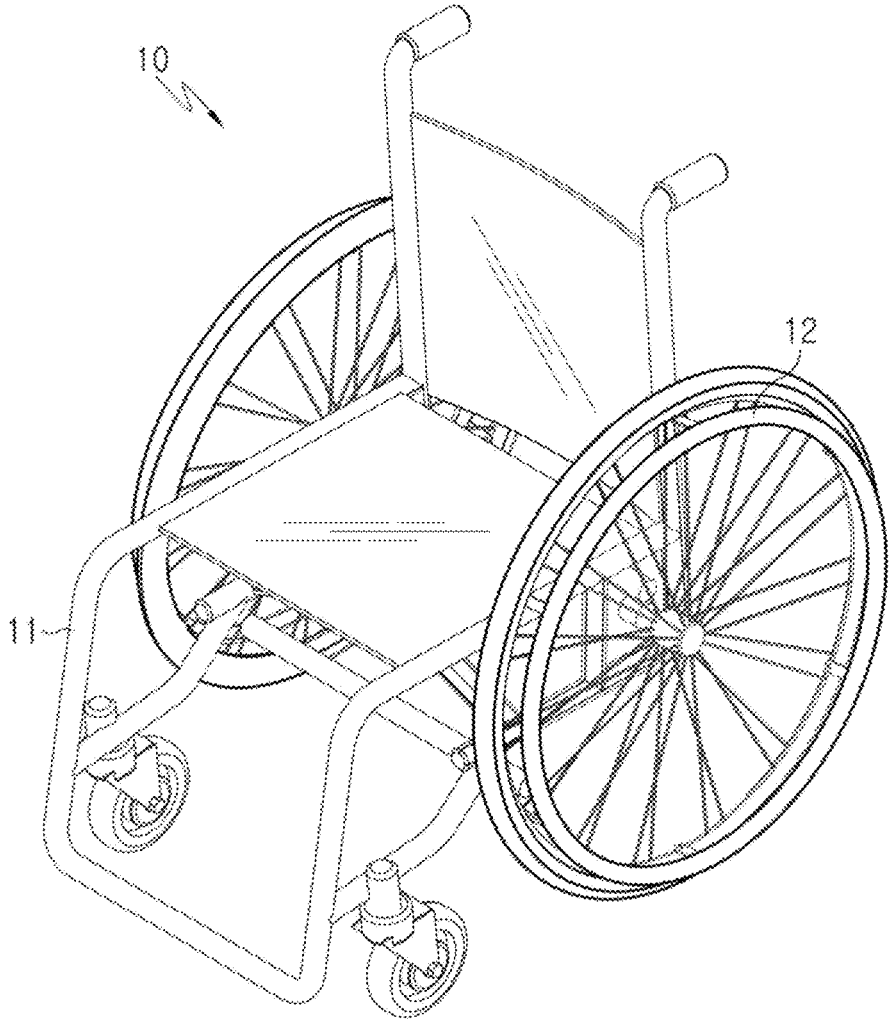

【Figure 2】
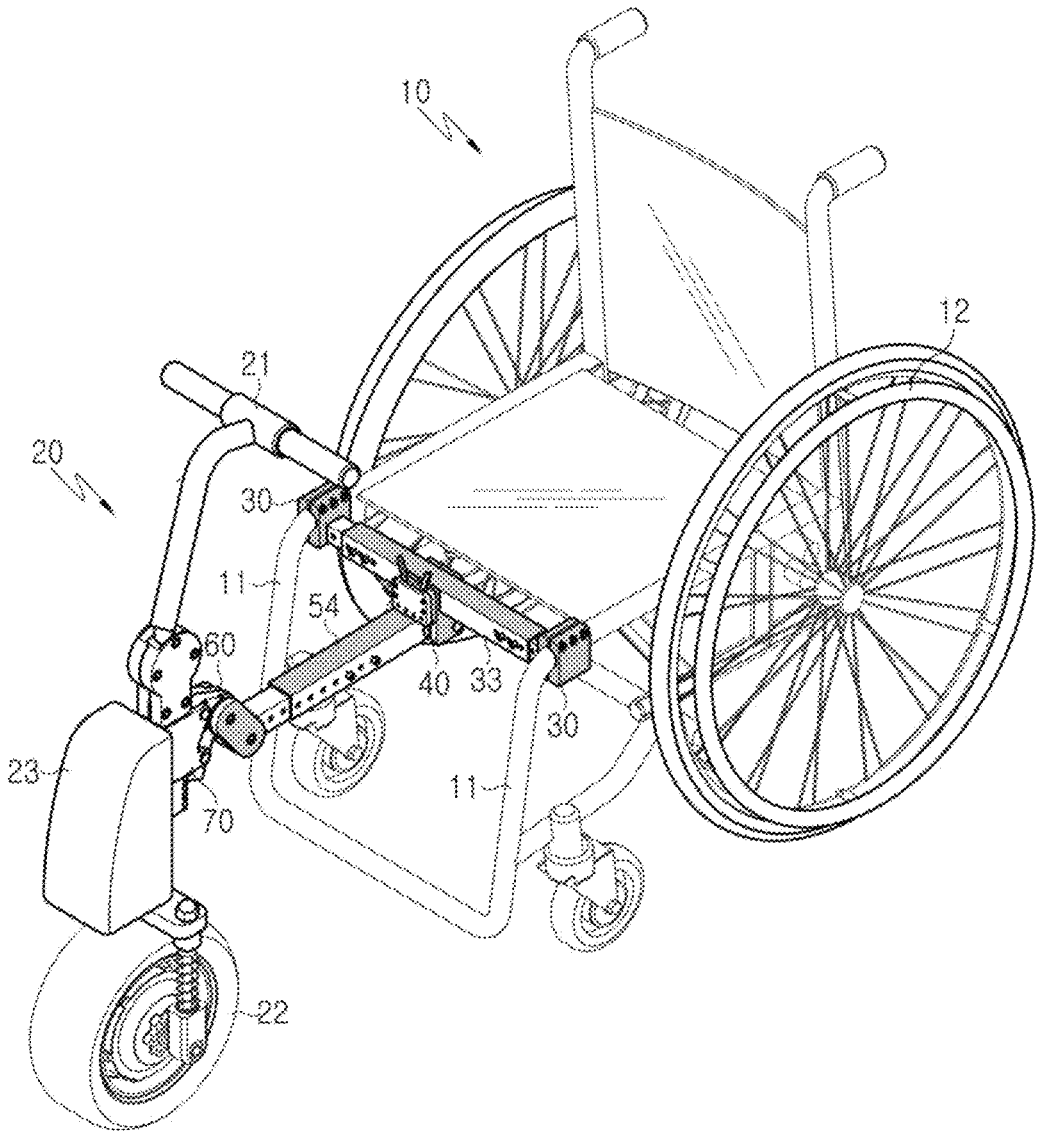

【Figure 3】
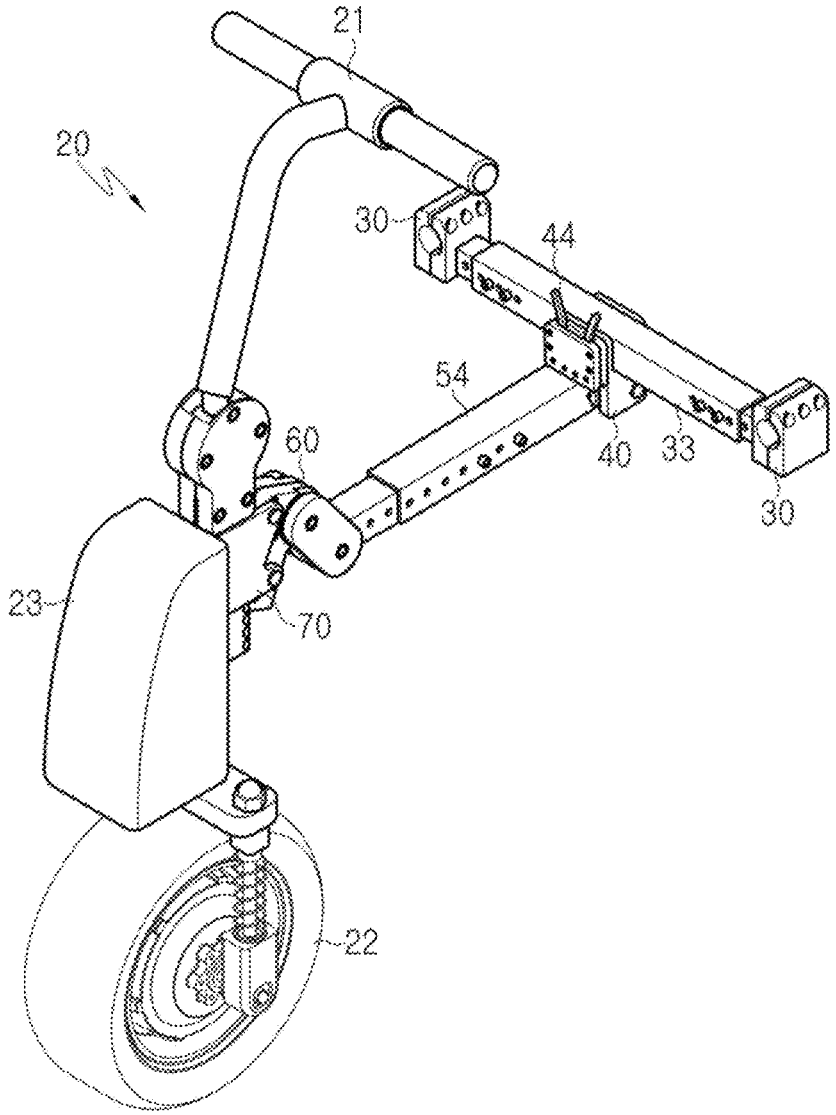

【Figure 4】
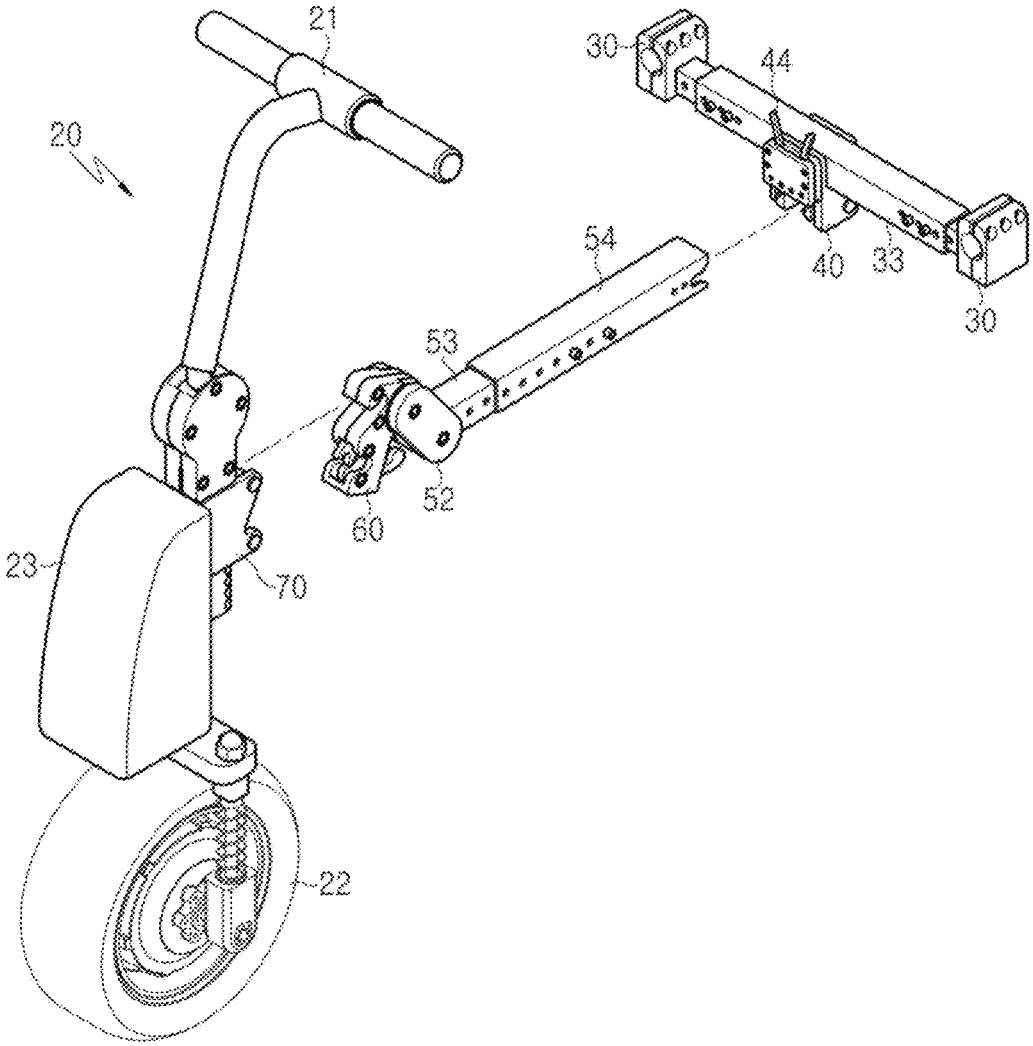

【Figure 5】
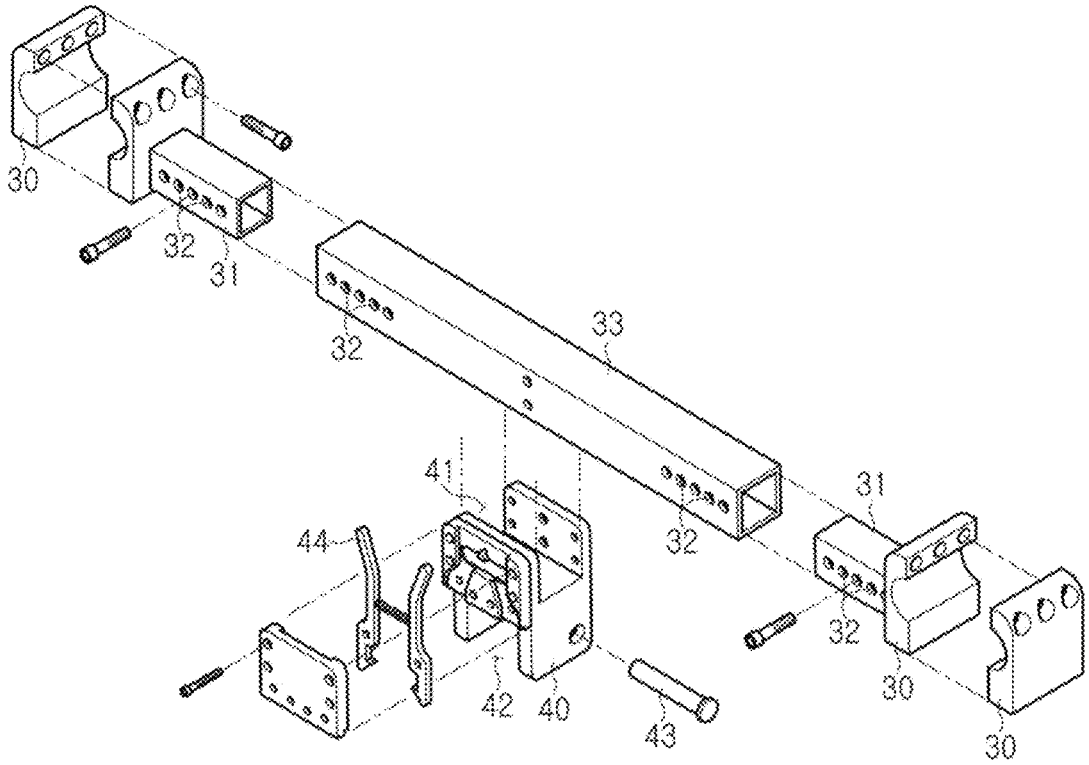
(a)
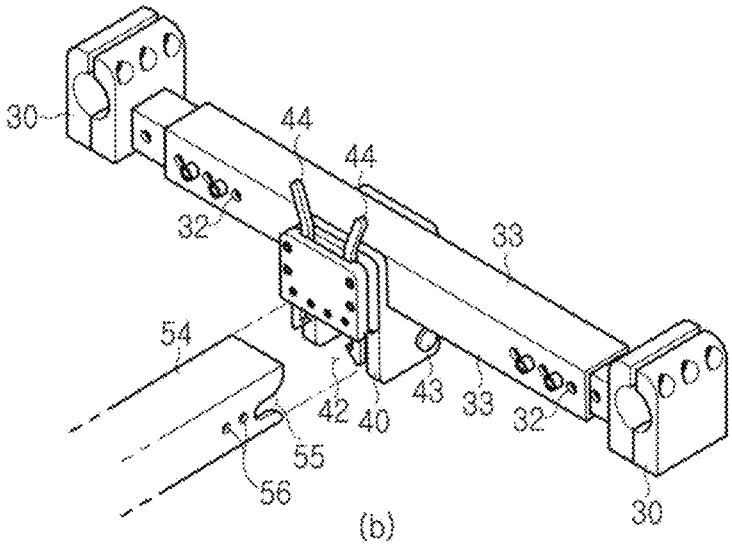
(b)

【Figure 6】
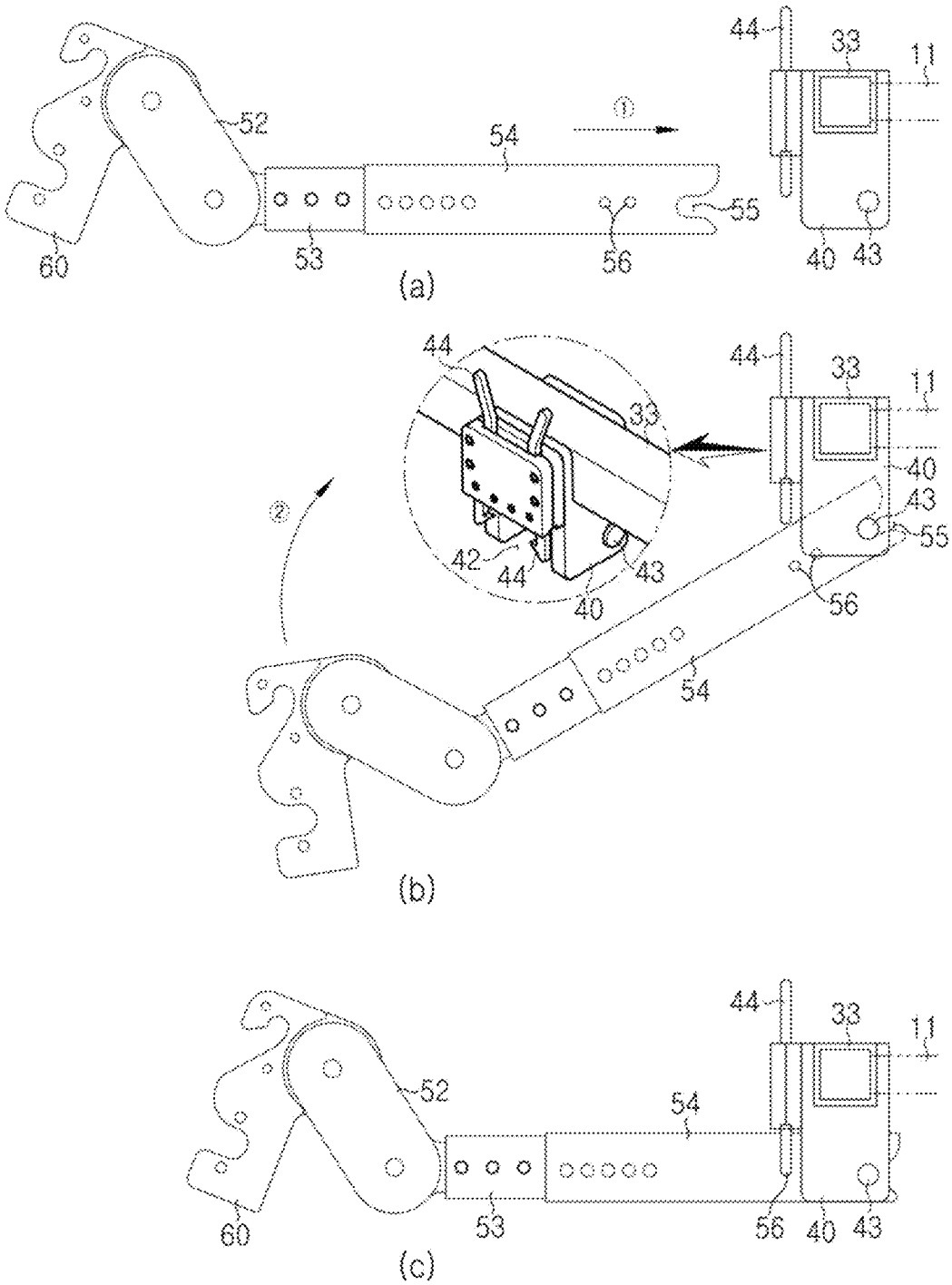

【Figure 7】
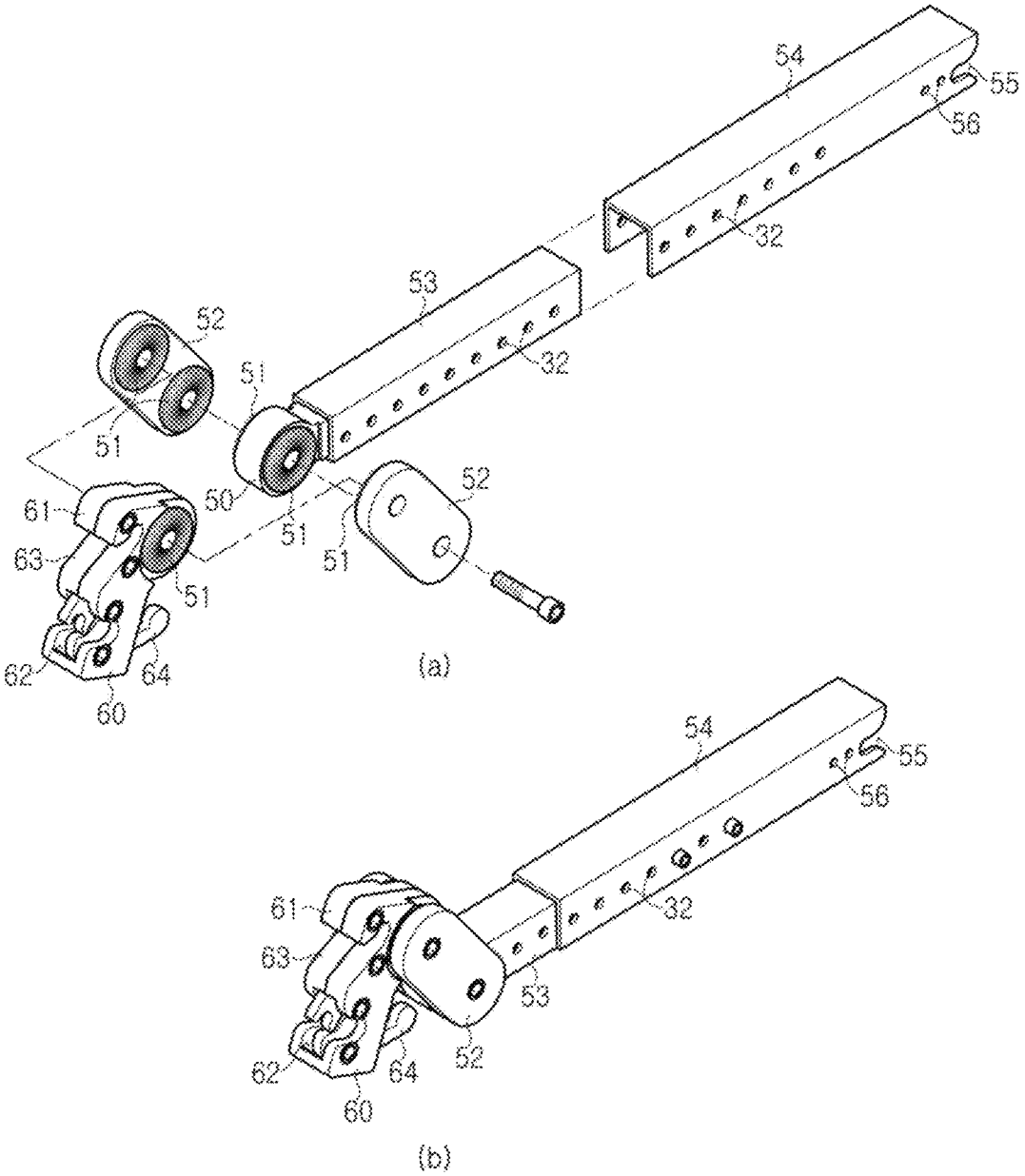

【Figure 8】
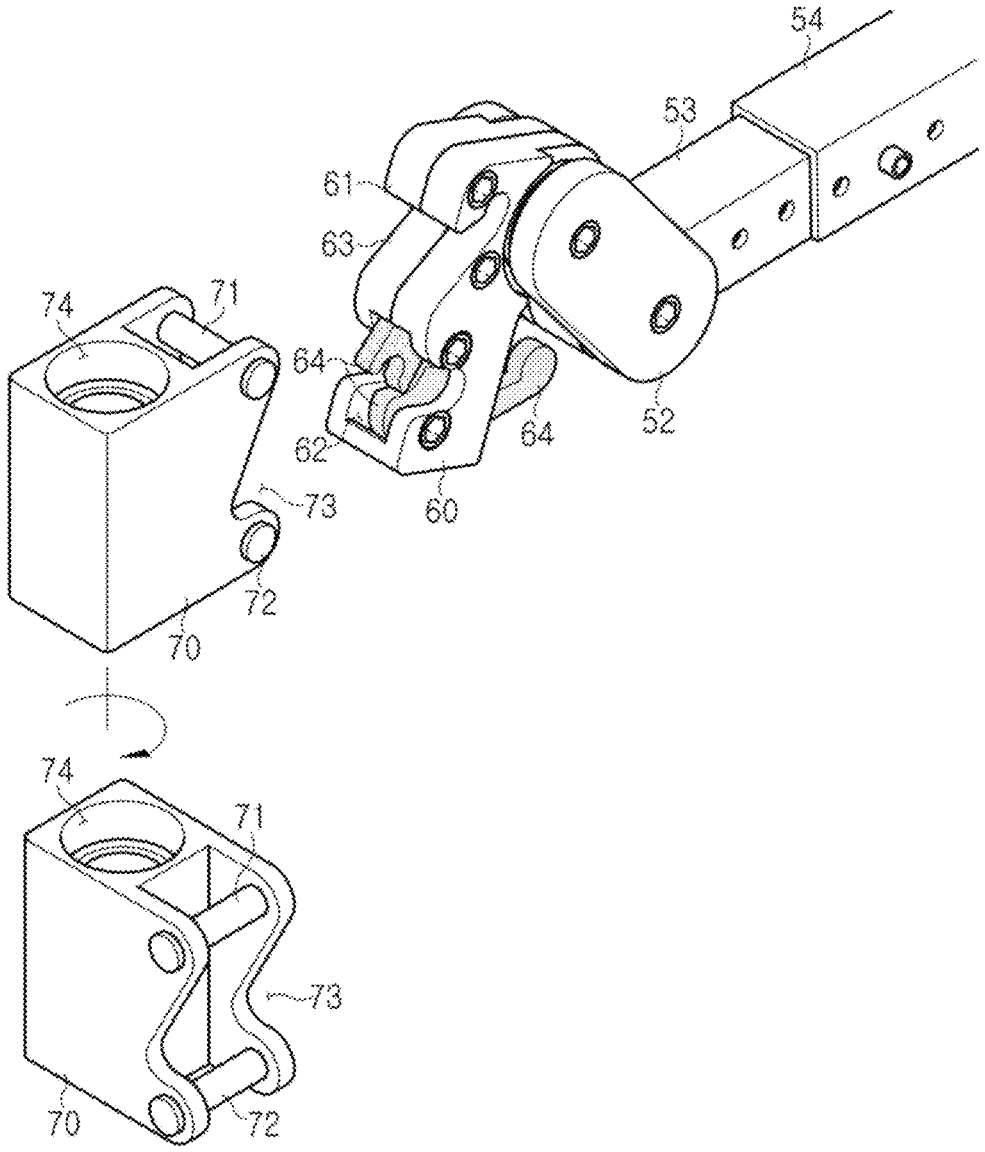

【Figure 9】
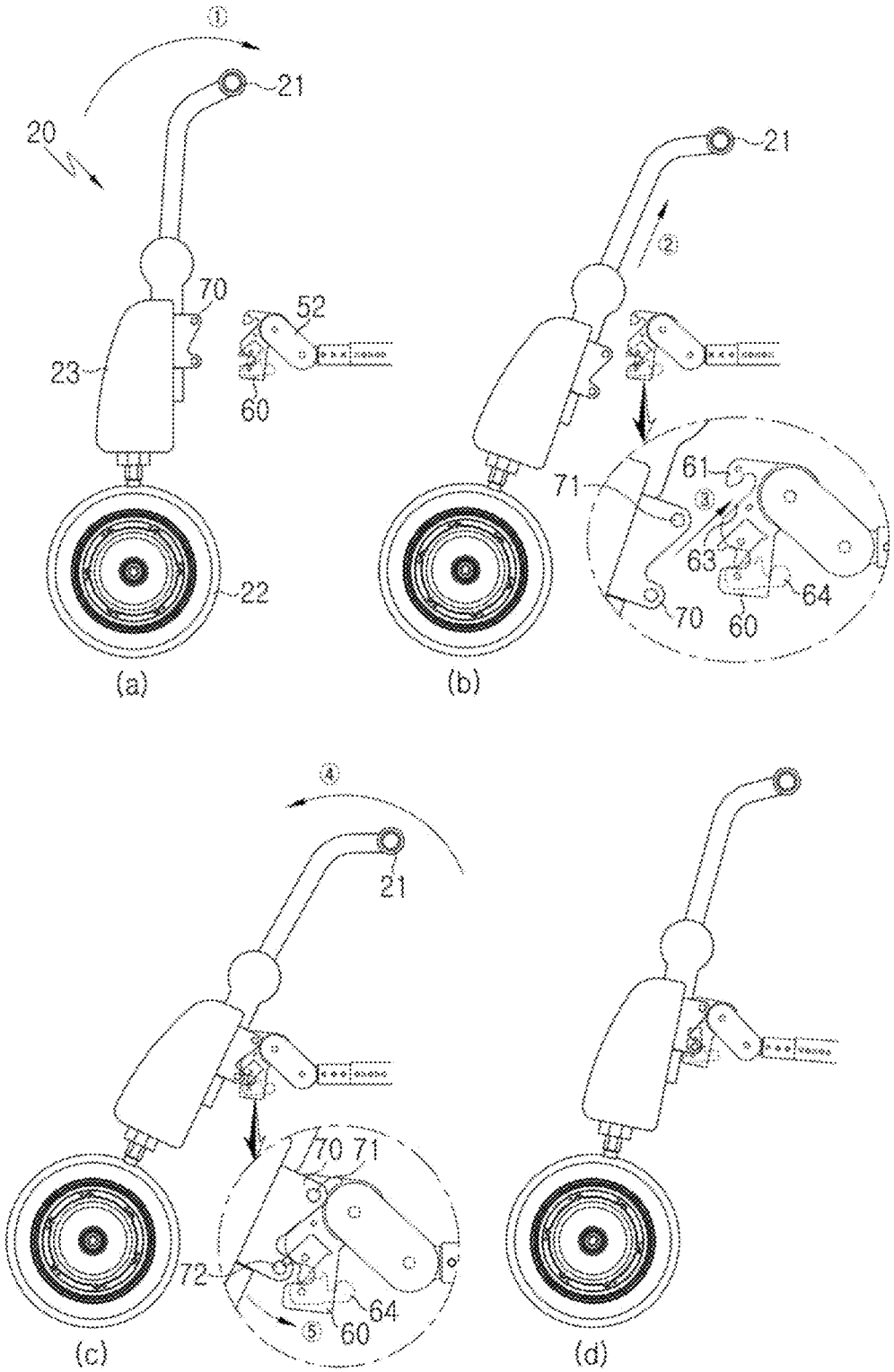

【Figure 10】
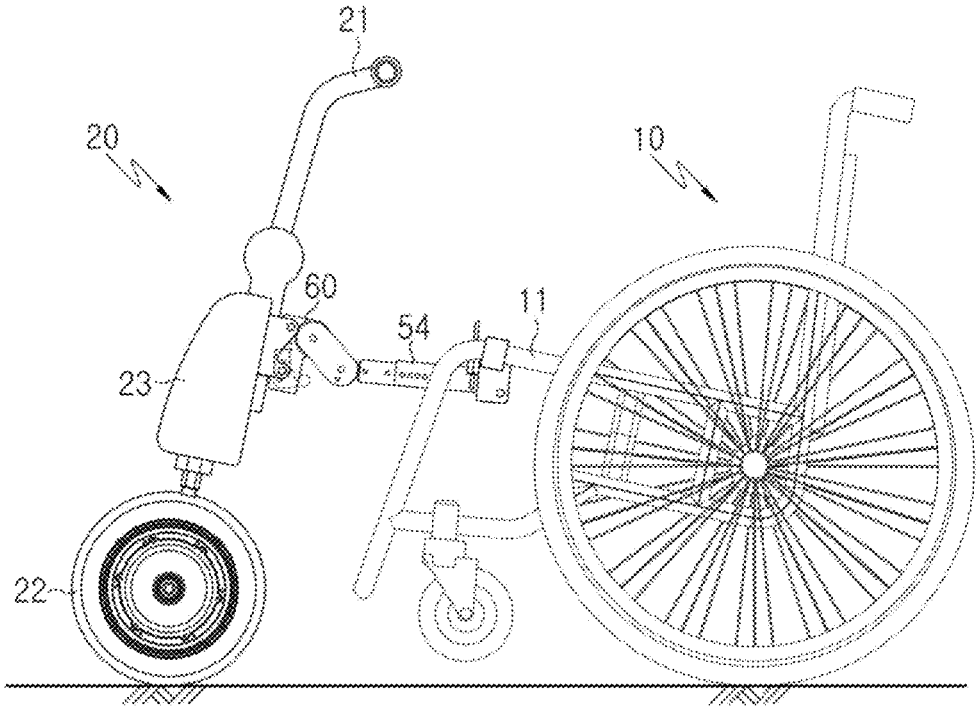

WHEELCHAIR POWER APPARATUS FOR ELECTRONIC DRIVING CONVERSION

BACKGROUND OF THE INVENTION

Field of the Invention

The present invention relates to a wheelchair power apparatus for electronic driving conversion, and more particularly, to a wheelchair power apparatus for electronic driving conversion, which can convert a manual wheelchair into an electronic wheelchair of a three-wheel type since having an electronic module detachably mounted on the manual wheelchair, which drives when a disabled person, an old person or a weak person rolls wheels with hands.

Background Art

FIG. 1 is a perspective view of a general wheelchair. The wheelchair 10 illustrated in FIG. 1 is a manual wheelchair 10, which is used as a transportation means for the disabled or the old. The wheelchair includes large wheels mounted at both sides of a seat for driving and small wheels mounted sides of foot rests to be able to rotate a full 360 degrees for direction change, so is operated in a four-wheel drive type.

The manual wheelchair 10 illustrated in FIG. 1 can be loaded on a vehicle for a long distance movement since being lightweight and being capable of narrowing the width between the wheels based on the seat to reduce volume. However, considering that a rider who is disabled holds an actuation rim 12 mounted along the edge of the wheel and operates the wheel just with muscle strength sitting on the seat, the manual wheelchair 10 is limited as an assistant transportation means for short-distance driving.

SUMMARY OF THE INVENTION

Accordingly, the present invention has been made to solve the above-mentioned problems occurring in the prior arts, and it is an object of the present invention to provide a wheelchair power apparatus for electronic driving conversion, which can provide severely disabled people, for instance, patients with spinal cord injury, the weak or the old, who use wheelchairs, with convenience in movement, and convert a manual four-wheel wheelchair into an electronic three-wheel wheelchair just by detachably mounting the electronic module having electronic wheels to the existing manual four-wheel wheelchair.

To accomplish the above object, according to the present invention, there is provided a wheelchair power apparatus for electronic driving conversion comprising: clamps mounted at both sides of a sheet frame of a manual wheelchair; a horizontal supporter mounted between the clamps; a combining hub mounted directly below the center of the horizontal supporter and having a combining means; a vertical supporter of which one end is mounted to the combining hub; an angle setting hub mounted at the other end of the vertical supporter and having radial saw parts formed at both sides thereof; and a coupling hub mounted on the angle setting hub, the coupling hub including a ring portion formed at the front thereof, an inclined surface formed downward from the ring portion, a coupling portion formed directly below of the inclined surface and having a coupling means, and radial saw parts formed at both sides of the rear of the ring portion, wherein the coupling hub is mounted to the angle setting hub by the medium of an angle setting bar having the radial saw parts formed at upper and lower portions, and a coupling unit mounted on an electronic module is assembled to the coupling hub in a detachable manner, so that the manual wheelchair is converted into an electronic wheelchair.

According to the present invention, the driving method of the wheelchair power apparatus for electronic driving conversion can provide the disabled, the weak or the old with convenience in movement by simply converting the existing manual wheelchair into the electronic wheelchair.

Furthermore, the wheelchair power apparatus for electronic driving conversion can reduce burden of expenses because there is no need to buy a high-priced electronic wheelchair, and can provide convenience in movement at a place to visit or at a vacation spot since a general electronic wheelchair cannot be loaded in a trunk of a vehicle but the wheelchair according to the present invention can be loaded in a trunk of a vehicle after the electronic module is separated from the manual wheelchair and the wheelchair is folded.

BRIEF DESCRIPTION OF THE DRAWINGS

The above and other objects, features and advantages of the present invention will be apparent from the following detailed description of the preferred embodiments of the invention in conjunction with the accompanying drawings, in which:

FIG. 1 is a perspective view of a general wheelchair;

FIG. 2 is a perspective view of a wheelchair on which an electronic module according to the present invention is mounted;

FIG. 3 is a perspective view of the electronic module according to the present invention;

FIG. 4 is an exploded perspective view of the electronic module according to the present invention;

FIG. 5 is a perspective view showing a clamp, a horizontal support, and a coupling hub according to the present invention;

FIG. 6 is a side view showing the order for explaining assembly of the horizontal support and a vertical support according to the present invention;

FIG. 7 is a perspective view showing an angle setting hub, the vertical support and a combining hub according to the present invention;

FIG. 8 is a perspective view showing a coupling unit according to the present invention;

FIG. 9 is a side view showing an assembly order of an electronic module according to the present invention;

FIG. 10 is a side view showing a combined state of the electronic module according to the present invention.

DETAILED DESCRIPTION OF THE PREFERRED EMBODIMENT

Hereinafter, reference will be now made in detail to the preferred embodiment of the present invention with reference to the attached drawings. In the description of the present invention, when it is judged that detailed descriptions of known functions or structures and systems related with the present invention may make the essential points vague, the detailed descriptions of the known functions or structures will be omitted.

FIG. 2 is a perspective view of a wheelchair on which an electronic module 20 according to the present invention is mounted. As shown in FIG. 2, a manual wheelchair 10 includes an electronic module 20 located at the front thereof. The electronic module 20 is detachably and firmly connected with a seat frame 11 of the wheelchair 10 through components, such as a clamp 30, a coupling hub 40, a horizontal support 33, a combining hub 60, and a vertical support 54.

The electronic module 20 includes: a driving wheel 22 in which an embedded motor 24 is mounted; a detachable battery 23 for supplying electric power; and an operation handle 21 mounted at an upper part to control driving. Not shown in the drawing, but the wheelchair according to the present invention includes a foothold mounted around the driving wheel 22, that is, is a self-balancing scooter, which runs in a self-balancing type depending on a rider's weight shift in a state that the rider stands on the foothold.

That is, when the rider, who stands on the foothold, grasps the operation handle 21 and leans his or her upper body forward at a predetermined angle, various sensors including a gyro sensor mounted previously read the slope, and the operation wheel 22 is operated in the direction of the slope as much as to offset the slope to prevent the scooter from falling forward due to the slope. So, the self-balancing scooter can run in safety while correcting its position in real time and keeping its upright position.

Robo3 Co., Ltd. which is an applicant of the present invention is mounting a tremendous effort to develop self-balancing scooters, and has made contributions to industrial development in this field by securing lots of patent rights and technologies. In this invention, the self-balancing scooter that ordinary persons stand erect to drive it is called the electronic module 20 which is applicable to a wheelchair.

FIG. 3 is a perspective view of the electronic module according to the present invention, and FIG. 4 is an exploded perspective view of the electronic module according to the present invention. The electronic module 20 located at the front of the manual wheelchair 10. The electronic module 20 is connected with a seat frame 11 of the wheelchair 10, and is detachably and conveniently combined through components, such as a clamp 30, a coupling hub 40, a horizontal support 33, a combining hub 60, and a vertical support 54, in a one-touch way.

FIG. 5 is a perspective view showing a clamp 30, the horizontal support 33, and a coupling hub 40 according to the present invention. As shown in FIG. 5(A), the clamp 30 is disposed on the seat frame 11 of the wheelchair 10. The clamp 30 is formed in a round shape at the center thereof in consideration that the seat frame 11 is generally formed in an annular shape, and is formed in a split shape to be mounted universally regardless of the size of the outer diameter of the seat frame 11.

As shown in FIG. 2, when the clamps 30 are mounted at both sides of the seat frame 11, the horizontal support 33 for connecting two clamps 30 is connected in a crosswise direction in a state that a rider sits thereon. Because wheelchairs 10 may be different in interval of the seat frame 11, a plurality of interval adjusting holes 32 are formed at both sides of the horizontal support 33, and a clamp adjuster 31 having a plurality of adjusting holes 32 is formed at one side of the clamp 30 to adjust the interval while being inserted into the horizontal support 33.

Furthermore, the coupling hub 40 is mounted directly below the center of the horizontal support 33. The coupling hub 40 includes: a seating groove 41 formed at an upper portion to allow the horizontal support 33 to be seated; an insertion groove 42 formed at a lower portion so that the vertical support 54 is fit thereinto; a support pin 43 located inside the insertion groove 42; and a clip type lock 44 mounted at the front.

Therefore, as shown in FIG. 5(B), when the vertical support 54 is fit into the insertion groove 42 of the coupling hub 40, the vertical support 54 is firmly mounted on the horizontal support 33 by the clip type lock 44 in a one-touch way.

Referring to FIG. 6, assembly of the horizontal support 33 and the vertical support 54 will be described. FIG. 6 is a side view showing the order for explaining assembly of the horizontal support and the vertical support according to the present invention. FIG. 6 illustrates the side of the seat frame 11 that the horizontal support 33 and the coupling hub 40 are mounted on the seat frame 11.

As shown in FIG. 6(A), the rider moves the vertical support 54 in the direction of arrow number ① toward the insertion groove 42 of the coupling hub 40 in a downwardly inclined state, so a support groove 55 of the vertical support 54 is combined with the support pin 43 of the coupling hub 40 as shown in FIG. 6(B).

In the above state, as shown in FIG. 6(B), when the rider rotates the vertical support 54 in the direction of arrow number ②, the vertical support 54 rotates stably based on the support pin 43 of the coupling hub 40, and finally, as shown in the perspective view of FIG. 6(B), a coupling hole 56 of the vertical support 54 is naturally coupled to the clip type lock 44. Therefore, the vertical support 54 and the horizontal support 33 are combined vertically as shown in FIG. 6(C).

FIG. 7 is a perspective view showing an angle setting hub 50, the vertical support 54 and a combining hub 60 according to the present invention, and FIG. 8 is a perspective view showing the combining unit 70 according to the present invention. As described above, the vertical support 54 is disposed to be combined to the horizontal support 33. As shown in FIG. 7(A), the support groove 55 is formed at one end of the vertical support 54, coupling holes 56 coupled with the clip type lock 44 are formed at both sides spaced apart from the support groove 55 at a predetermined interval, and the plurality of interval adjusting holes 32 are formed at both sides of the vertical support 54.

Moreover, as shown in FIG. 7(A), the angle setting hub 50 having radial saw-toothed parts 51 formed at both sides is disposed, an angle adjuster 53 is formed at one side of the angle setting hub 50, and a plurality of length adjusting holes 32 are formed at both sides of the angle adjuster 53. Therefore, a distance between the electronic module 20 and the rider can be adjusted according to the rider's physical conditions while the angle adjuster 53 is fit into the vertical support 54.

Furthermore, as shown in FIG. 7(A), the combining hub 60 directly combined with the electronic module 20 is disposed, and the radial saw-toothed parts 51 are formed at both sides of the rear portion of the upper part of the combining hub 60, so that the combining hub 60 and the angle setting hub 50 are combined with each other through a long angle setting bar 52 having the radial saw-toothed parts 51 formed at upper and lower portions.

That is, as shown in FIG. 7(A), the radial saw-toothed parts 51 formed at the lower portion of the angle setting bar 52 are combined with the radial saw-toothed parts 51 formed on the angle setting hub 50, and the radial saw-toothed parts 51 formed on the upper portion of the angle setting bar 52 are combined with the radial saw-toothed parts 51 formed on the combining hub 60. Therefore, when the assembly is completed as shown in FIG. 7(B), the most convenient driving posture suitable for the rider's physical conditions can be set accurately according to an angle adjusting method.

Meanwhile, as shown in FIG. 8, the combining unit 70 combined with the combining hub 60 is mounted on the electronic module 20 as shown in FIGS. 3 and 4, and is a means for mounting the electronic module 20 to the combining hub 60.

First, the combining hub 60 will be described in more detail. As shown in FIGS. 7 and 8, the radial saw-toothed parts 51 are formed at both sides of the rear portion of the upper part of the combining hub 60, a hook part 61 is formed at the front of the upper part of the combining hub 60, an inclined surface 63 is formed downwardly from the hook part 61, and a combining portion 62 is formed directly below the inclined surface 63. A snatch lock 64 is mounted inside the combining portion 62 as a combining means, so that a combining pin 72 of the combining unit 70 is caught to the snatch lock 64 in the one-touch way.

As shown in FIG. 8, the combining unit 70 includes a holding pin 71 mounted at the front of the upper part to be combined with the hook part 61 of the combining hub 60; the combining pin 72 mounted directly blow the holding pin 71 to be combined with the snatch lock 64 at the combining portion 62 of the combining hub 60 in the one-touch ways; an inclination corresponding groove 73 formed between the holding pin 71 and the combining pin 72 to correspond to the inclined surface 63 of the combining hub 60; and a fitting hole 74 formed at the rear of the combining unit 70 to be mounted to a shaft of the electronic module 20.

Referring to FIG. 9, the order that the electronic module 20 is mounted on the combining hub 60 will be described. FIG. 9 is a side view showing the assembly order of the electronic module 20 according to the present invention, as shown in FIG. 9(A), the rider who sits on a seat holds the operation handle 21 of the electronic module 20 and rotates the operation handle 21 in the direction of the arrow number ① so as to inclinedly locate the electronic module 20.

After that, as shown in FIG. 9(B), when the rider pulls the inclined electronic module 20 toward the rider's chest in the direction of the arrow number ②, as you can see from the enlarged view of FIG. 9(B), the holding pin 71 of the combining unit 70 moves along the inclined surface 63 of the combining hub 60 in the direction of the arrow number ③, and is caught to the hook part 61.

After that, as shown in FIG. 9(C), in a state that the holding pin 71 of the combining unit 70 and the hook part 61 of the combining hub 60 are assembled together, when the rider pushes the electronic module 20 in the direction of the arrow number ④ to rotate, the electronic module 20 rotates stably around the holding pin 71 of the combining unit 70, and the combining pin 72 of the combining unit 70 rotates toward the snatch lock 64 mounted in the combining portion 62 of the combining hub 60 in the direction of the arrow number ⑤ in the one-touch way as shown in the enlarged view of FIG. 9(C), so that the electronic module 20 can be conveniently mounted on the combining hub 60 as shown in FIG. 9(D).

FIG. 10 is a side view showing combination of the electronic module 20 according to the present invention. As shown in FIG. 10, when the electronic module 20 is mounted on the manual wheelchair 10, the 360-degree rotatable small wheels assembled to the wheelchair is lifted from the ground and is conveniently converted from the manual four-wheel type wheelchair into the electronic three-wheel type wheelchair to provide the disabled or the weak with convenience in movement.

Meanwhile, considering that the wheelchair having the electronic module is a detachable type, for long-distance movement, the manual wheelchair is folded and loaded on a vehicle and the electronic module 20 and other coupling means are separated from the wheelchair and loaded on the vehicle. At a destination, the manual four-wheel wheelchair is converted into the electronic three-wheel wheelchair, so the wheelchair according to the present invention provides vulnerable users with convenience in movement and enriches their lives.

What is claimed is:

1. A wheelchair power apparatus for electronic driving conversion comprising:

clamps mounted at both sides of a sheet frame of a manual wheelchair;

a horizontal supporter mounted between the clamps;

a combining hub mounted directly below the center of the horizontal supporter;

a vertical supporter of which one end is mounted to the combining hub;

an angle setting hub mounted at the other end of the vertical supporter and having radial saw parts formed at both sides thereof; and a coupling hub mounted on the angle setting hub, the coupling hub including a ring portion formed at the front thereof, an inclined surface formed downward from the ring portion, a coupling portion formed directly below of the inclined surface, and radial saw parts formed at both sides of the rear of the ring portion, wherein the coupling hub is mounted to the angle setting hub by the medium of an angle setting bar having the radial saw parts formed at upper and lower portions, and a coupling unit mounted on an electronic module is assembled to the coupling hub in a detachable manner, so that the manual wheelchair is converted into an electronic wheelchair.

2. The wheelchair power apparatus according to claim 1, wherein the coupling unit comprises: a holding pin mounted at the front of an upper portion to be combined with the ring portion of the coupling hub; a coupling pin mounted directly below the holding pin to be coupled with a snatch lock, which is embedded in the coupling portion of the coupling hub, in a one-touch manner; an inclined groove formed between the holding pin and the coupling pin to correspond and coupled to the inclined surface of the coupling hub; and a fitting hole formed at the rear of the coupling unit to be mounted on a shaft of the electronic module.

3. The wheelchair power apparatus according to claim 1, wherein an angle setting controller is formed at one side of the angle setting hub, a plurality of length-adjustable holes are formed at both sides of the angle setting controller, and a plurality of control holes are formed at both sides of the vertical supporter, so that a distance between the electronic module and a rider is adjusted according to the rider's physical conditions while the angle setting controller is fit to the vertical supporter.

4. The wheelchair power apparatus according to claim 1, wherein the combining hub comprises: a seating groove formed at an upper portion thereof in order to put the horizontal supporter thereon; an insertion hole formed at a lower portion to insert the vertical supporter thereinto; a support pin mounted inside the insertion hole, and wherein a support groove formed at an end portion of the vertical supporter is combined with the support pin of the combining hub, and a clip lock is combined with coupling holes formed at both sides to be spaced apart from the support groove at a predetermined interval.

5. The wheelchair power apparatus according to claim 1, wherein the clamps are attached to a clamp controller formed in between the clamps and having a plurality of interval adjusting holes formed at both sides, so that an interval between the clamps is adjusted according to an interval of the sheet frame while the clamp controller having the plurality of adjusting holes formed at both sides is fit to the vertical supporter.

6. The wheelchair power apparatus according to claim 1, wherein the electronic module includes a self-balancing scooter.

* * * * *